United States Patent [19]

Espedal

[11] 4,445,444

[45] May 1, 1984

[54] BURNER FOR COMBUSTING OXYGEN-COAL MIXTURE

[75] Inventor: Michael L. Espedal, Houston, Tex.

[73] Assignee: Texaco Inc., White Plains, N.Y.

[21] Appl. No.: 407,397

[22] Filed: Aug. 12, 1982

[51] Int. Cl.[3] ..... F23D 1/00

[52] U.S. Cl. ..... 110/261; 110/262; 110/265; 110/263; 431/4; 431/190

[58] Field of Search ..... 110/261–265, 110/347; 431/190, 4

[56] References Cited

U.S. PATENT DOCUMENTS

| | | | |
|---|---|---|---|
| 2,381,803 | 8/1945 | Breault | 431/190 |
| 2,482,260 | 9/1949 | Goddard | 431/190 |
| 2,702,743 | 2/1955 | Totzek | 110/261 |
| 3,085,865 | 4/1963 | Long et al. | 110/261 |
| 3,215,098 | 11/1965 | Nelson | 431/190 |
| 3,299,841 | 1/1967 | Hemker et al. | 110/262 |
| 3,327,762 | 6/1967 | Saha | 431/190 |
| 3,801,261 | 4/1974 | Reed et al. | 431/4 |
| 3,984,528 | 10/1976 | Cheng et al. | 110/265 |
| 3,993,431 | 11/1976 | Oda et al. | 431/190 |
| 4,030,889 | 6/1977 | Gunnell | 110/262 |

FOREIGN PATENT DOCUMENTS

| | | | |
|---|---|---|---|
| 28861 | 5/1981 | European Pat. Off. | 110/263 |
| WO80/2452 | 11/1980 | PCT Int'Appl. | 110/263 |

*Primary Examiner*—Henry C. Yuen

*Attorney, Agent, or Firm*—Robert A. Kulason; Robert Knox, Jr.; Robert B. Burns

[57] ABSTRACT

Burner for use in a coal gasification process wherein a combustible mixture is formed comprising a combustion supporting gas such as oxygen, and a coal slurry. To avoid deposition of slag and ash particles along the hot, exposed face of the burner, a dynamic fluid blanket or barrier is directed transversely of the burner face. The fluid flow originates at the burner periphery and is addressed to sweep, or impinge against at least a part of the burner face adjacent to the central opening which defines the burner discharge port.

5 Claims, 3 Drawing Figures

FIG. 1
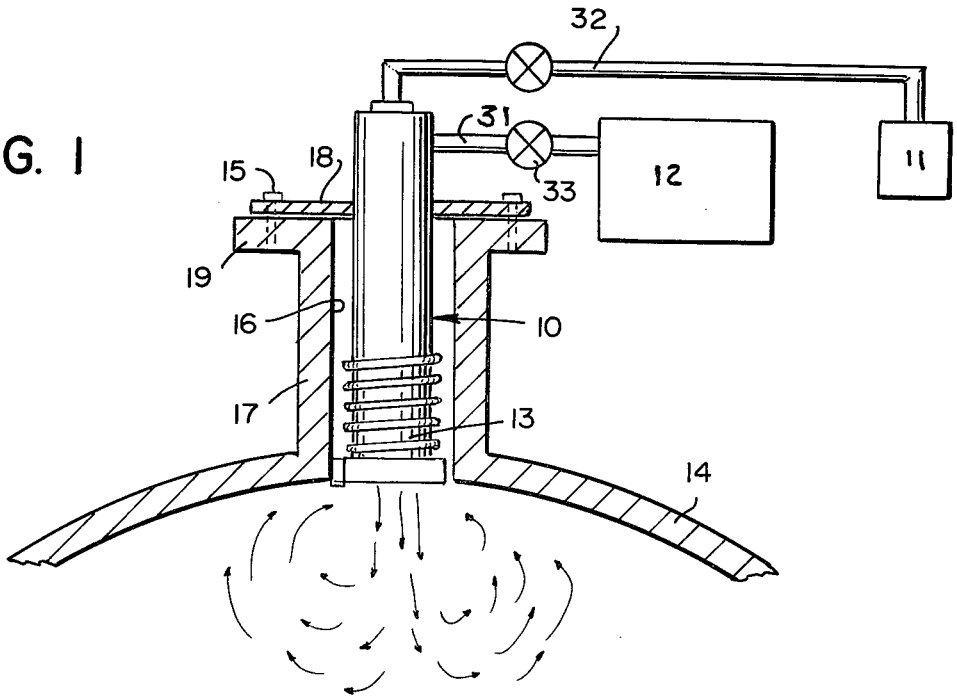
FIG. 2
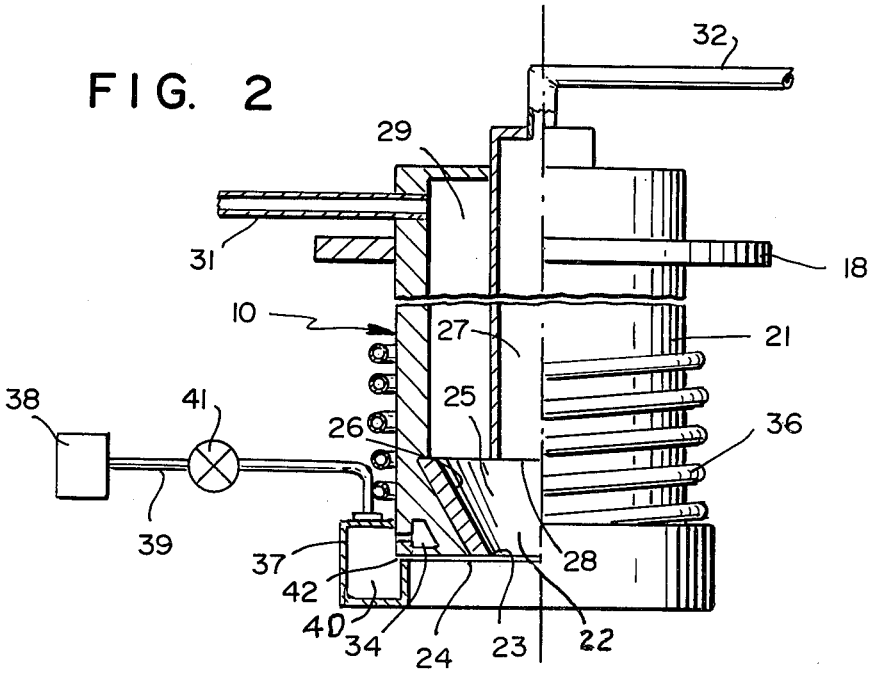
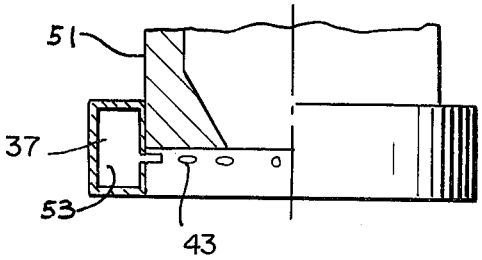
FIG. 3

BURNER FOR COMBUSTING OXYGEN-COAL MIXTURE

BACKGROUND OF THE INVENTION

1. Field of the Invention

This invention relates to a burner for introducing a combustible mixture comprising hydrocarbon fuel, free oxygen-containing gas, and optionally a temperature moderator (liquid or vapor) into a free-flow partial oxidation synthesis gas generator.

2. Description of the Prior Art

In the partial combustion of a hydrocarbon with oxygen, or air enriched with oxygen, in the presence of steam and/or carbon dioxide, temperatures between 1,100° and 1,500° C. are often reached. Special requirements are therefore placed on the design and the material from which the burner is constructed to avoid damage to the latter.

An essential requirement in burner construction of the type contemplated is that they be cooled or otherwise protected from the high temperature environment. This is most often achieved by circulating water or a similar coolant through the unit. Thus, by constructing the burner both internally and externally with coolant passages, a sufficient amount of heat transfer to the circulating cooling fluid can be achieved to minimize and stabilize the temperature which the burner itself reaches.

Normally, the oxidizing flame which combusts the mixture, introduces the hot flame as well as the products of combustion into a reactor or generator. The latter is lined with a suitable refractory material to avoid damage as a result of the high temperatures that will be reached and sustained.

A relatively vulnerable part of the burner is that section which is continuously exposed for extended periods of time to the high reactor temperatures. Although means have been provided for cooling internal segments of the burner, the problems which result from the high temperature still persist.

For example, external walls of the burner are generally surrounded with a cooling coil or the like which circulates a liquid such as water to effectuate a cooling action. Further, the lower or flame end of the burner is provided with internal passages which permit coolant to be internally circulated to maintain a desired temperature range.

In either instance, the forward most vulnerable face of the burner, can reach certain temperatures, or range of temperatures within which accumulations of particular slag or ash will tend to cling to the exposed burner face. Such a slag build-up will cause a reduction in burn efficiency and eventually impairment of operation and eventual unit shutdown.

These accumulations are prompted generally by back mixing of the combustible particles or ash as the particles enter the reactor. Here they are caught up into the violently turbulent flows of the gas as associated with the high velocity flame.

More specifically it is found that if the temperature on the exposed burner face is in excess of 750° to 900° F., ash particles will be prone to stick thereto. If, on the other hand, the temperature is kept lower than 750° to 900° F. on the face of the burner, the ash sticking will be substantially avoided.

In burners that function as required, it is found that a particle build-up along the burner face will generally commence at the lip of the discharge opening or nozzle. Thereafter, the build-up will progress radially outward from the nozzle and gradually cover a substantial segment of the exposed face. Slag will also build upon itself due to progressive insulation from cooling coil/channel.

One way for precluding or at least limiting this slag build-up along the burner face is to inject steam directly into the combustible mixture within the burner itself. This step will facilitate the avoidance of undesired build-ups at the discharge lip. It will not, however, completely preclude the accumulations as herein mentioned.

For example, the back mixing and flow of the particulated matter as a result of the turbulence immediately inside the reactor, will continue to cause or prompt a certain degree of build-up at the burner face.

Toward overcoming the above stated problems, the present invention is addressed to means for providing a fluid, dynamic shield which protects the entire burner face. The shield is provided in the form of one or more jets of a fluid such as steam, which are projected transversely of the face from a point at the burner periphery.

A number of fluids such as steam, $CO_2$ or even water could serve as the protective dynamic shield. For the present disclosure, however, the fluid will be considered to be steam.

Physically, one or more high velocity steam jets are caused to sweep the burner face. The jets first of all form a barrier which precludes the hot particles from getting to, or contacting the face. Secondly, the fluid jet is so aligned that it will flow parallel to the face, or will contact or impinge against the face preferably adjacent to the discharge lip. This creates a thermal radiation/-convection shield to keep burner face below 750° to 900° F. Thirdly, the flow will thus clear the face of any accumulation that might be initiated.

It is therefore an object of the invention to provide a burner which is adapted for use in combusting a coal-oxygen mixture to achieve a partial oxidation of the gaseous product. A further object is to provide a burner of the type contemplated that is capable of withstanding undesired particulate depositions along the burner exposed face. A still further object is to provide a burner of the type contemplated wherein one or more high velocity fluid jets are directed to sweep the burner face and maintain it free of accumulated particulate matter and to concurrently protect the face by establishing a fluidized radiation/convection shield thereacross.

DESCRIPTION OF THE DRAWINGS

FIG. 1 is a segmentary view in cross-section of a portion of a partial oxidation generator, showing the burner unit. FIG. 2 is an enlarged view in partial cross-section of the burner shown in FIG. 1. FIG. 3 is an alternate embodiment shown in partial cross-section of the burner discharge end.

DESCRIPTION OF THE APPARATUS

One embodiment of a partial oxidation apparatus of the type generally contemplated is shown in FIG. 1 and comprises primarily a burner 10. The latter is normally connected to a source of oxygen 11 as well as to a source 12 of particulated hydrocarbon such as a coal slurry or the like. Thus the two elements when introduced to the burner, will form a combustible mixture.

It will be appreciated that an apparatus of this type is subjected to sustained high internal temperatures and is formed basically of a steel shell. The shell's inner walls and openings therefore, while not specifically shown here, are so constructed and lined with a refractory material that they will withstand the harsh environment.

The discharge end 13 of burner 10 is positioned to introduce the resulting flame as well as the products of combustion into refractory lined reactor 14. In the latter, the hot products of the partial combustion are collected.

Reactor or generator 14 is provided with a refractory lined with a refractory lined opening 16 within which burner 10 is positioned. Said opening 16 as shown can include an elongated neck 17 which surrounds the burner itself to provide a degree of protection thereto. The upper end of the burner 10 is provided with a flange 18 which corresponds with a support flange 19. The latter projects outwardly from reactor neck 17 to hold the burner 10 in place, and yet permit its ready removal for replacement or repair.

Burner 10 comprises primarily an elongated body 21 having a longitudinal passage which extends the length of the body 21. The lower end of said passage terminates at a constricted, cylindrical opening 22 which is defined by a peripheral lip 23 at the burner face 24. A progressively narrowing wall 26 connects the body elongated passage with lip 23, to define a mixing compartment 26.

The elongated passage through body 21 is provided with a conduit 27 disposed preferably coaxially thereof, discharge port 28 terminates at mixing compartment 26 between said conduit 27 and said discharge port.

The proper positioning of conduit 27 defines an elongated annular passage 29 between the conduit walls, and the adjacent walls of the body 21. Annular passage 29 is communicated with source 12 of coal slurry and/or steam, by way of a valved conductor 31 to permit the introduction of the of the subsequently formed combustible mixture, into the mixing compartment 26.

For the present description, oxygen will be referred to as the combustion supporting medium which is introduced through the central conduit 27 by way of valved conduit 32.

In a similar manner, annular passage 29 is communicated with conductor passage 31 which is operable through valve 33 to regulate the volume of particulated or finely ground coal mixture which is introduced from source 12 for combining with the oxygen to establish the desired combustible mixture in mixing compartment 26.

The lower face 24 of burner body 21 as herein noted is normally exposed to the maximum temperature and turbulent environment experienced within reactor 14. Said lower face 24 is normally formed of a heat resistant material such as inconel or the like which will be capable of functioning in spite of the high temperatures to which it is constantly exposed. However, said burner face 24, although capable of withstanding the elevated temperatures, is nonetheless susceptible to the herein noted accumulations.

To achieve the desired degree of cooling within the burner 10, the latter is provided with one or more internally, strategically positioned channels such as 34. The latter are arranged to circulate a coolant, preferably water. The cooling water channels are so arranged within burner body 21 to establish adequate heat removing capability thereby to stabilize the temperature within burner mixing compartment 26 and to protect the entire unit from excessive heating.

Further cooling of the unit is achieved on body 21 by an externally positioned cooling coil 36. The latter is formed as shown of a thermally conductive material to withstand the extreme temperatures, and yet be capable of conducting a flow of water at a sufficient rate to maintain a desired temperature gradient.

To avoid the herein mentioned undesired solid deposit of ash, slag and other particulate matter along the face 24 of the burner, an annular manifold 37 is provided. The manifold cooperates with burner 10 and is communicated with a pressurized source of steam 38 by way of pipe 39 and control valve 41.

In the embodiment shown, annular manifold 37 depends from lower end of the body 21, and extends preferably slightly forward of face 24. Said manifold 37 comprises an essence a closed annular chamber 40 which is formed of a series of welded plates or compartments. The latter are adapted to either engage the lower end of the burner itself, or to be positioned sufficiently close thereto as to permit regulation of the steam flow which is projected transversely of the burner face.

As shown in FIG. 2, in one embodiment manifold 37 is provided with a single constricted opening 42 which communicates with the steam chamber 40 or compartment to direct a pressurized jet of steam across the burner face 24. To function most effectively, the steam preferably traverses across burner face 24 in a substantially uninterrupted pattern.

Thus, the steam will achieve at least two functions. Firstly, the steam will define a dynamic curtain or barrier across the burner face 24 to substantially preclude slag or ash particles from contacting the face. Secondly, the velocity of the steam will be such that it will dislodge any solid accumulation which might be initiated at lip 23. Thirdly, the disposition of the jet will be such as to provide a thermal radiation shield.

The volume of steam which leaves constructed opening 42 will be regulated to avoid adversely affecting production of a partially oxidized product.

As presently shown, manifold 37 is connected directly to, and depends from the peripheral forward end of burner body 21. In such an instance, the manifold 37 provides an annular arragement which can be either welded or otherwise fastened in place to extend slightly forward of the burner face 24.

In an alternate embodiment, the manifold can be arranged to cooperate with neck 17 of reactor 14. In such an instance, the torus-like manifold is adapted to slidably register the forward end of burner 10 and to properly position face 24 with respect to constricted opening 42 thereby permitting the steam jet from the latter to sweep across face 24.

In still another embodiment of the manifold and as shown in FIG. 3, the burner 51 can comprise an arrangement similar to that shown in FIG. 2. Here, however, manifold 52 can be provided with a plurality of discrete constricted openings 43. The latter as shown define a plurality of passages, each of which is communicated with the manifold chamber 53 to receive the pressurized fluid.

The respective openings 43 are provided with a configuration such that the high velocity steam which leaves the respective openings is directed centrally toward the longitudinal axis of burner 10.

Openings 43 can further be constructed as to provide the issuing steam with a particular configuration. In one embodiment, the configuration can be substantially in the form of a fan-like flow to best provide the desired overlapping coverage across the face of burner 24.

In any event the plurality of streams will be directed substantially parallel to face 24 to form the barrier and achieve the above noted two functions, i.e. providing a shield, and also keeping the face clear of solid matter.

In a further embodiment of the steam manifold, the latter can be provided with a single constricted opening as shown in FIG. 2, or with a plurality of circularly arranged and spaced apart constricted openings as shown in FIG. 3.

In either instance, the steam directing openings are spaced downwardly from face 24 rather than positioned contiguously therewith. Thus, the dynamic barrier or shield forming steam will be directed upwardly from the spaced apart openings and toward face 24. The focus of the steam jets in this instance will be at the discharge lip 43.

Fine particulate ash or slag will thereby be caught up into the steam jet and carried away from face 24. Further, any solid material that does engage or cling to lip 23 will be dislodged and swept away by the steam impinged thereagainst.

It is found that by use of the present arrangement, the life of the burner 10 can be greatly facilitated and the replacement thereof deferred for longer periods of time than would be a similar burner without the presently disclosed shielding facility.

I claim:

1. A burner (10) for combusting a mixture of powdered hydrocarbon and a combustion supporting medium, to form a stream of a produced gas which burner comprises;

an elongated burner body (21) defining a mixing chamber (26) therein, means communicating said mixing compartment with discrete sources of the powdered hydrocarbon (12) and the combustion supporting medium (11), a peripheral lip (23) at one end of said elongated body (21) defining a discharge nozzle (28) which communicates with said mixing compartment (26), and through which lip (23) said stream of produced bgas issues, said elongated burner body (21) including a face (24) disposed adjacent to the peripheral lip (23), a manifold (37) disposed contiguous with said burner body (21), being spaced radially outward of said discharge nozzle lip (23) and communicated with a source of a pressurized fluid (38), a plurality of constricted ports (43) formed in said manifold (37), being spaced radially apart, adjacent to said face, and aligned toward said peripheral lip (23) to direct a plurality of jets of said fluid from the manifold (37) toward the said peripheral lip (23), whereby to form a dynamic, fluid barrier which extends transversely of the burner face (24) to avoid the deposition of ash particles on the said face.

2. In the apparatus as defined in claim 1, wherein said said ports are disposed substantially contiguous with the burner face so that said jet of fluid will be projected in a path substantially parallel to said burner body face.

3. In the apparatus as defined in claim 1, wherein said said ports are spaced radially away from said burner face and is aligned in a direction to direct said at least one jet of fluid toward the nozzle peripheral lip.

4. In the apparatus as defined in claim 1, wherein said ports are lined with an abrasion resistant material.

5. In the apparatus as defined in claim 1, wherein said ports include; replaceable nozzles formed in said manifold wall to define said plurality of openings.

* * * * *